US010193256B1

(12) United States Patent
Chen

(10) Patent No.: US 10,193,256 B1
(45) Date of Patent: Jan. 29, 2019

(54) POWER SUPPLY BOARD BRIDGE CONNECTOR AND CONNECTING STRUCTURE USING THE SAME

(71) Applicant: Xiamen GHGM Industrial Trade Co., Ltd., Xiamen (CN)

(72) Inventor: Bingshui Chen, Xiamen (CN)

(73) Assignee: XIAMEN GHGM INDUSTRIAL TRADE CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/869,066

(22) Filed: Jan. 12, 2018

(51) Int. Cl.

| | |
|---|---|
| ***H01R 12/00*** | (2006.01) |
| ***H01R 13/10*** | (2006.01) |
| ***H01R 13/05*** | (2006.01) |
| ***H01R 12/70*** | (2011.01) |

(52) U.S. Cl.
CPC ..... *H01R 13/10* (2013.01); *H01R 12/7088* (2013.01); *H01R 13/055* (2013.01)

(58) Field of Classification Search
CPC ... H01R 13/10; H01R 12/7088; H01R 13/055
USPC ..... 439/325, 65, 507, 513
See application file for complete search history.

(56) References Cited

U.S. PATENT DOCUMENTS 4,907,991 A * 3/1990 Kobayashi ..... H05K 3/4685 29/843
4,915,636 A * 4/1990 Knight ..... H05K 7/1418 439/630
5,026,290 A * 6/1991 Dery ..... H01R 12/52 439/494
6,299,469 B1 * 10/2001 Glovatsky ..... F02D 9/02 439/329
6,634,910 B2 * 10/2003 Lieb ..... H05K 7/1465 439/271
7,203,074 B1 * 4/2007 Yaung ..... H05K 1/142 29/830
7,488,200 B2 * 2/2009 Yamamoto ..... H01R 12/52 439/511
7,618,283 B1 * 11/2009 Costello ..... H01R 12/585 439/511
7,841,860 B1 * 11/2010 Chen ..... H01R 13/2442 439/513
8,328,571 B2 * 12/2012 Mulfinger ..... G06F 1/185 439/260
8,548,397 B1 * 10/2013 Bausch ..... H04M 1/0262 439/495

(Continued)

*Primary Examiner* — Abdullah Riyami
*Assistant Examiner* — Nelson R Burgos-Guntin
(74) *Attorney, Agent, or Firm* — Muncy, Geissler, Olds & Lowe, P.C.

(57) ABSTRACT

A power supply board bridge connector includes an insulating cover to cover an insulating base which is formed with at least one receiving groove. A bottom of the insulating base is formed with through holes. At least two pins provided beneath the insulating base are mated with insertion holes of two left and right power supply boards so that the insulating base bridges over the two power supply boards. The metallic elastic plate is placed in the receiving groove. The metallic elastic plate has two left and right elastic contacts passing through the through holes at the bottom of the receiving groove to be electrically connected to the left and right power supply boards. The structure is simple, the connection is convenient, firm and stable, and the connection efficiency is high.

6 Claims, 4 Drawing Sheets

(56) References Cited

U.S. PATENT DOCUMENTS

| | | | | |
|---|---|---|---|---|
| 8,986,020 | B2 * | 3/2015 | Ishii | H01R 11/01 439/511 |
| 2001/0012723 | A1 * | 8/2001 | Tanaka | H01R 13/2435 439/507 |
| 2007/0147975 | A1 * | 6/2007 | Homner | F16B 5/0642 411/510 |
| 2007/0293082 | A1 * | 12/2007 | Sumitani | H01H 85/2035 439/507 |
| 2008/0171451 | A1 * | 7/2008 | Shin | H01R 12/721 439/65 |
| 2008/0293262 | A1 * | 11/2008 | Duesterhoeft | H01R 12/78 439/65 |
| 2009/0269976 | A1 * | 10/2009 | Costello | H01R 12/585 439/510 |
| 2010/0159717 | A1 * | 6/2010 | Takeuchi | H01R 13/20 439/65 |
| 2011/0104911 | A1 * | 5/2011 | Sypolt | H01R 12/58 439/65 |
| 2013/0157480 | A1 * | 6/2013 | Swedberg | H01R 12/523 439/65 |
| 2014/0295681 | A1 * | 10/2014 | Miyaki | H01R 24/84 439/65 |
| 2015/0171528 | A1 * | 6/2015 | Wu | H01R 12/7082 439/65 |

* cited by examiner

POWER SUPPLY BOARD BRIDGE CONNECTOR AND CONNECTING STRUCTURE USING THE SAME

BACKGROUND OF THE INVENTION

1. Field of the Invention

The present invention relates to a power supply board bridge connector, and more particularly to a power supply board bridge connector and a connecting structure using the same.

2. Description of the Prior Art

In the prior art, two power supply boards are connected by using wires. The connection is inconvenient, the operation efficiency is low, and the connection is not stable. Accordingly, the inventor of the present invention has devoted himself based on his many years of practical experiences to solve these problems.

SUMMARY OF THE INVENTION

The primary object of the present invention is to provide a power supply board bridge connector and a connecting structure using the same. The structure is simple, the connection is convenient, firm and stable, and the connection efficiency is high.

According to one aspect of the present invention, a power supply board bridge connector is provided. The power supply board bridge connector comprises an insulating base, an insulating cover, and at least one metallic elastic plate. The insulating cover is configured to cover the insulating base. At least one receiving groove is defined between the insulating base and the insulating cover. A bottom of the insulating base is formed with through holes communicating with the receiving groove. At least two left and right pins are provided beneath the insulating base. The pins are mated with insertion holes of two left and right power supply boards so that the insulating base bridges over the two power supply boards. The metallic elastic plate is placed in the receiving groove. The metallic elastic plate has two left and right elastic contacts. The two left and right elastic contacts pass through the through holes at the bottom of the receiving groove to be electrically connected to the left and right power supply boards respectively so as to achieve a bridging electrical connection between the two power supply boards.

Preferably, a middle of the bottom of the insulating base is formed with a spacer for separating the left and right power supply boards from each other. Preferably, a middle of the receiving groove is provided with a support post for supporting the metallic elastic plate. The support post cooperates with the insulating cover to position the metallic elastic plate in the receiving groove.

Preferably, the metallic elastic plate is in the form of a strip. Left and right ends of the metallic elastic plate are bent downward to form arc sections and then extend toward the support post to form extension sections respectively. The extension sections protrude downward to form the elastic contacts.

Preferably, each of the elastic contacts is formed with a slit.

Preferably, opposing sides of the insulating base are provided with side slots corresponding in position to the pins. Lower ends of the side slots extend to the pins, respectively. Each of the side slots is provided with a metallic buckle. The metallic buckle has a mounting plate abutting against a wall of the corresponding side slot. A bottom of the mounting plate of the metallic buckle is bent upward to form an elastic plate. The elastic plate is formed with a buckle protrusion to mate with respective edges of the insertion holes for installing and fixing the insulating base and the power supply boards. An upper end of the elastic plate is formed with a press portion above the power supply boards. When the press portion is pressed towards the mounting plate in the corresponding side slot, the buckle protrusion is disengaged from the edges of the insertion holes to disconnect the insulating base from the power supply boards.

According to another aspect of the present invention, a connecting structure using the aforesaid power supply board bridge connector is provided. The two left and right power supply boards are formed with the insertion holes. The left and right pins at the bottom of the insulating base are mated with the insertion holes of the two left and right power supply boards so that the insulating base bridges over the two power supply boards. The two left and right elastic contacts of the metallic elastic plate pass through the through holes at the bottom of the receiving groove to be electrically connected to the left and right power supply boards respectively so as to achieve the bridging electrical connection between the two power supply boards.

The present invention has a simple structure. When assembled, the two left and right pins beneath the insulating base are respectively mated with the insertion holes of the two left and right power supply boards so that the insulating base bridges over the two power supply boards, meanwhile, the two elastic contacts at the left and right sides of the metallic elastic plate are electrically connected to the two left and right power supply boards respectively to achieve the bridging electrical connection. In the present invention, the electrical connection between the two power supply boards is convenient, firm and stable, and the connection efficiency is high.

DETAILED DESCRIPTION OF THE PREFERRED EMBODIMENTS

Embodiments of the present invention will now be described, by way of example only, with reference to the accompanying drawings.

Figure 1:
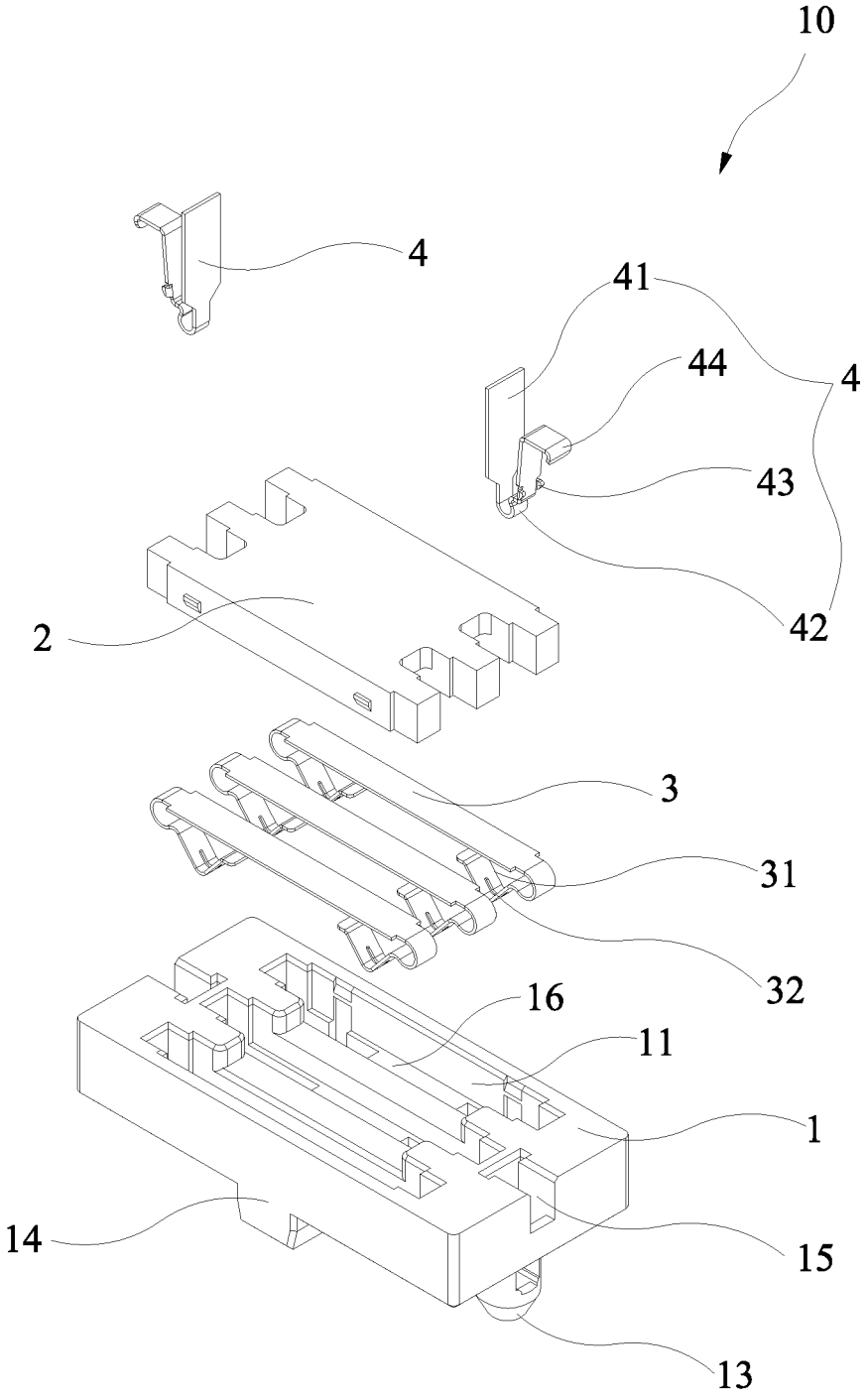
FIG. 1 is an exploded view of the present invention.
Figure 2:
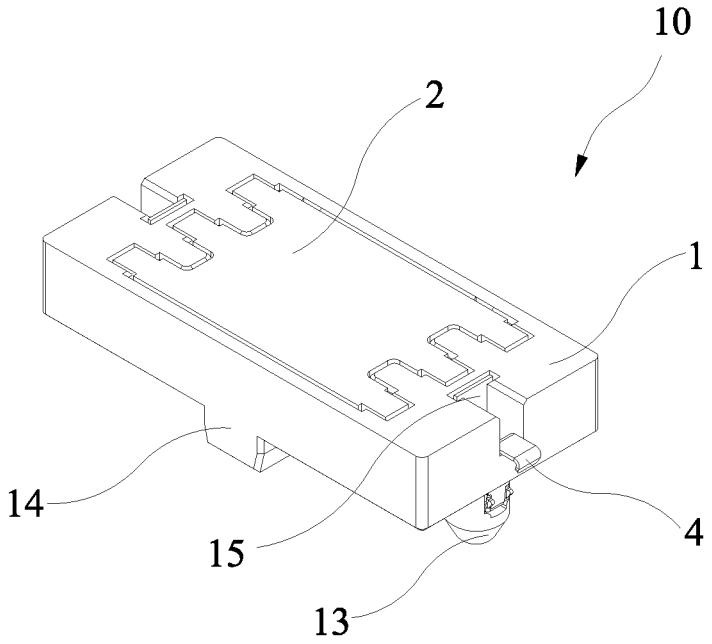
FIG. 2 is a top view of the present invention.
Figure 3:
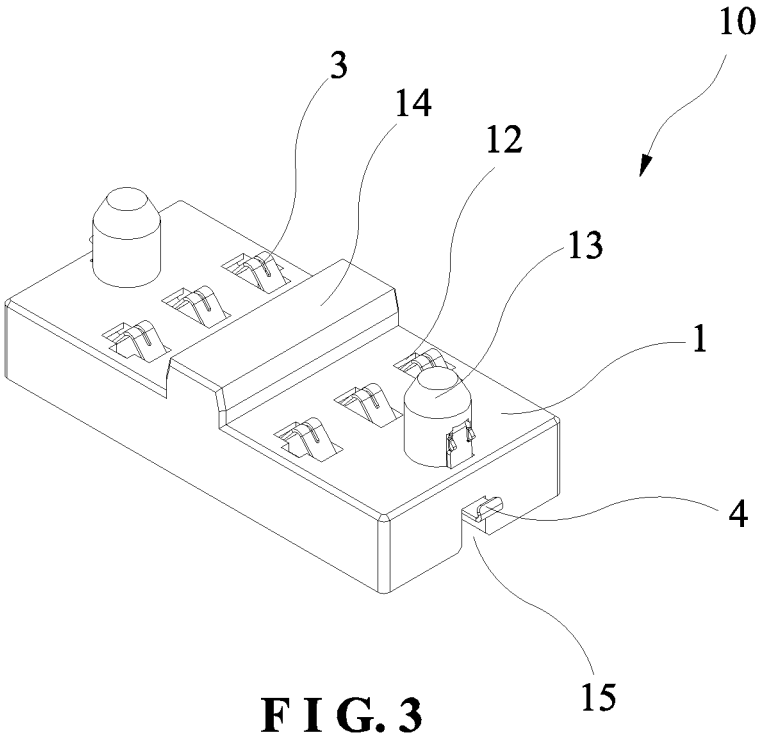
FIG. 3 is a bottom view of the present invention.
Figure 4:
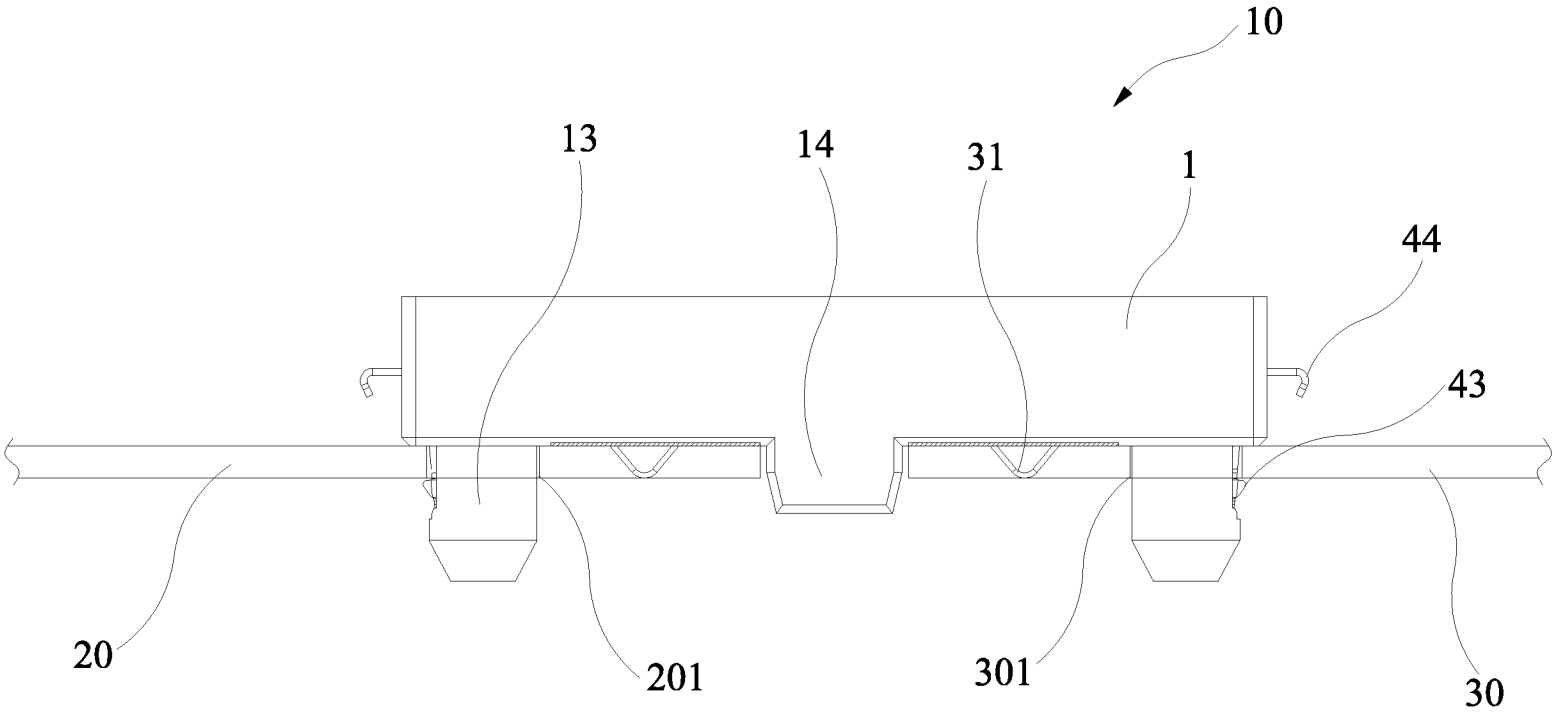
FIG. 4 is a side view of the present invention when in use.
Figure 5:
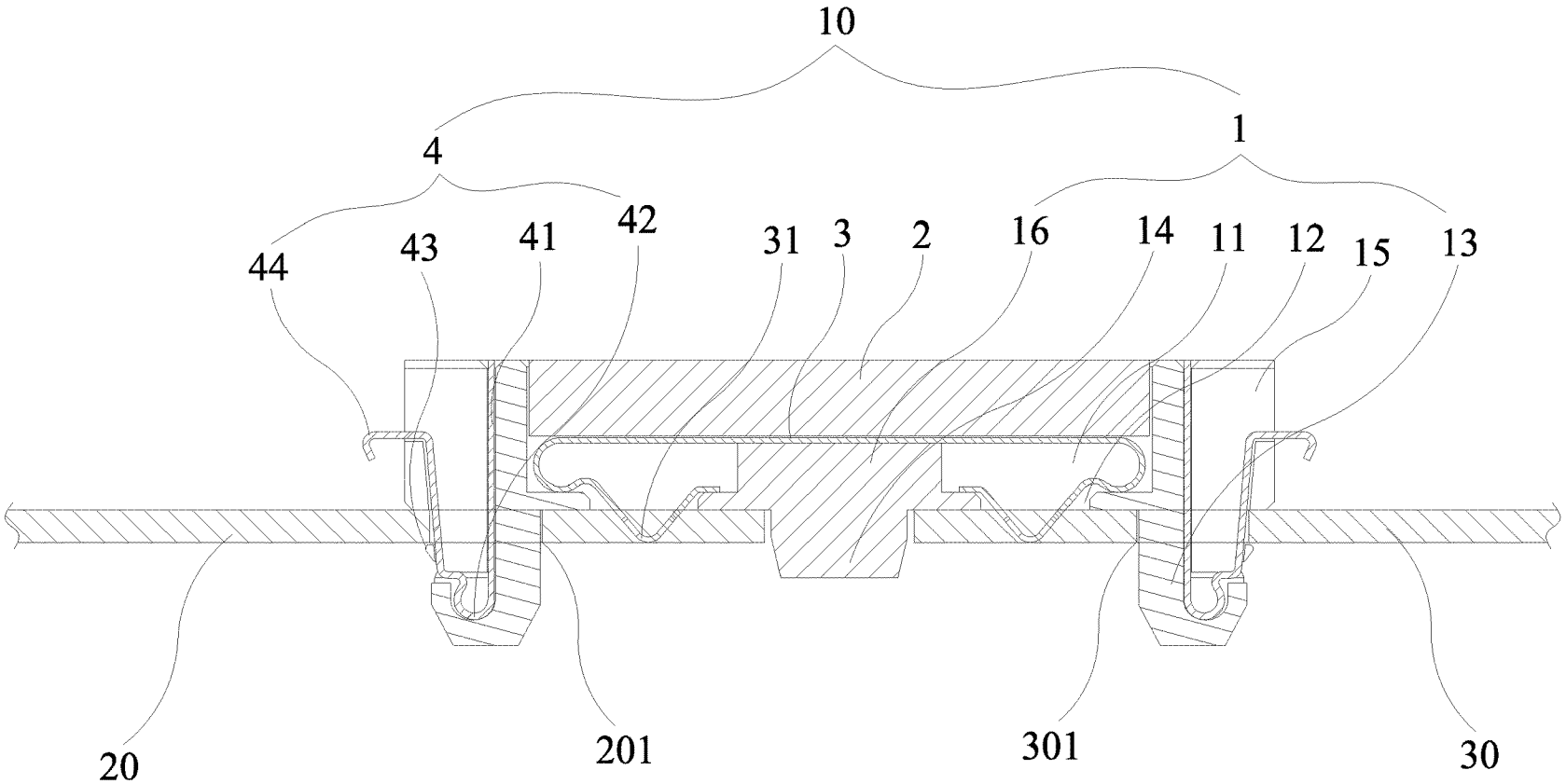
FIG. 5 is a sectional view of the present invention when in use.

As shown in FIG. 1 to FIG. 5, the present invention discloses a power supply board bridge connector 10 comprising an insulating base 1, an insulating cover 2, and at least one metallic elastic plate 3. The insulating cover 2 is configured to cover the insulating base 1. At least one receiving groove 11 is defined between the insulating base 1 and the insulating cover 2. The bottom of the insulating base 1 is formed with through holes 12 communicating with the receiving groove 11 is defined in At least two left and right pins 13 are provided beneath the insulating base 1. The pins 13 are mated with insertion holes 201, 301 of two left and right power supply boards (PCB) 20, 30, so that the insulating base 1 bridges over the two power supply boards 20, 30. The metallic elastic plate 3 is placed in the receiving groove 11. The metallic elastic plate 3 has two left and right elastic contacts 31. The two left and right elastic contacts 31 pass through the through holes 12 at the bottom of the receiving groove 11 to be electrically connected to the left and right power supply boards 20, 30 respectively so as to achieve the bridging electrical connection between the two power supply boards 20, 30. The electrical connection of the present invention is convenient, firm and stable, and has high connection efficiency.

In order to accurately position the two power supply boards 20, 30 when connected, the middle of the bottom of the insulating base 1 is formed with a spacer 14 for separating the left and right power supply boards 20, 30 from each other. When connected, the two left and right power supply boards 20, 30 are pressed against the spacer 14, and then the pins 13 are inserted into the insertion holes 201, 301 to complete the quick and accurate connection.

The pins 13 and the insertion holes 201, 301 may be fixed by an interference fit, or may be fixed by a structure which is easy to be disassembled. As shown in the figures of this embodiment, the disassembly structure is that the opposing sides of the insulating base 1 are provided with side slots 15 corresponding in position to the pins 13. The lower ends of the side slots 15 extend to the pins 13, respectively. Each side slot 15 is provided with a metallic buckle 4. The metallic buckle 4 has a mounting plate 41 abutting against the wall of the corresponding side slot 15. The bottom of the mounting plate 41 of the metallic buckle 4 is bent upward to form an elastic plate 42. The elastic plate 42 is formed with a buckle protrusion 43. The buckle protrusion 43 is configured to buckle the edges of the insertion holes 201, 301 so that the pins 13 are fixed in the insertion holes 201, 301 to realize the installation and fixing of the insulating base 1 and the power supply boards 20, 30. The upper end of the elastic plate 42 is formed with a press portion 44 above the power supply boards 20, 30. When the press portion 44 is pressed towards the mounting plate 41 in the side slot 15, the buckle protrusion 43 is disengaged from the edges of the insertion holes 201, 301 and retracted into the side slot 15 to disconnect the insulating base 1 from the power supply boards 20, 30. The connector 10 can be easily removed from the power supply boards 20, 30.

In order to facilitate the installation and positioning of the metallic elastic plate 3, the middle of the receiving groove 11 is provided with a support post 16 for supporting the metallic elastic plate 3. The support post 16 cooperates with the insulating cover 2 to position the metallic elastic plate 3 in the receiving groove 11. Preferably, the metallic elastic plate 3 is in the form of a strip. The left and right ends of the metallic elastic plate 3 are bent downward to form arc sections and then extend toward the middle support post 16 to form extension sections, respectively. The extension sections protrude downward to form the elastic contacts 31. Each of the elastic contacts 31 is formed with a slit 32 to improve the contact effect and ensure the electrical connection.

The present invention also discloses a connecting structure using the above-mentioned power supply board bridge connector 10. The two left and right power supply boards 20, 30 are formed with the insertion holes 201, 301. The left and right pins 13 at the bottom of the insulating base 1 are mated with the insertion holes 201, 301 of the two left and right power supply boards 20, 30, so that the insulating base 1 bridges over the two power supply boards 20, 30. The two left and right elastic contacts 31 of the metallic elastic plate 3 pass through the through holes 12 at the bottom of the receiving groove 11 to be electrically connected to the left and right power supply boards 20, 30 respectively so as to achieve the bridging electrical connection between the connector 10 and the two power supply boards 20, 30.

The insulating base 1 of the present invention is used to accommodate the metallic elastic plate 3 and the metallic buckle 4 and provide an electrical isolation function. The insulating cover 2 plays a role of fixing the metallic elastic plate 3. The metallic elastic plate 3 plays a role of conduction through the elastic contacts 31. The metallic buckle 4 is configured to connect the connector 10 with the power supply boards 20, 30, thereby preventing disengagement. The number of the metallic elastic plates 3 depends on the circuit design of the power supply boards 20, 30. One metallic elastic plate 3 corresponds to one receiving groove 11. The number of the pins 13 can be determined according to the size of the insulating base 1 to ensure the stability of the bridge. One pin 13 may be provided with one metallic buckle 4.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A power supply board bridge connector, comprising an insulating base, an insulating cover, and at least one metallic elastic plate, the insulating cover being configured to cover the insulating base, at least one receiving groove is defined between the insulating base and the insulating cover, a bottom of the insulating base being formed with through holes communicating with the receiving groove, at least two left and right pins being provided beneath the insulating base, the pins being mated with insertion holes of two left and right power supply boards so that the insulating base bridges over the two power supply boards, the metallic elastic plate being placed in the receiving groove, the metallic elastic plate having two left and right elastic contacts, the two left and right elastic contacts pass through the through holes at the bottom of the receiving groove to be electrically connected to the left and right power supply boards respectively so as to achieve a bridging electrical connection between the two power supply boards, wherein opposing sides of the insulating base are provided with side slots corresponding in position to the pins, lower ends of the side slots extend to the pins respectively, each of the side slots is provided with a metallic buckle, the metallic buckle has a mounting plate abutting against a wall of the corresponding side slot, a bottom of the mounting plate of the metallic buckle is bent upward to form an elastic plate, the elastic plate is formed with a buckle protrusion to mate with respective edges of the insertion holes for installing and fixing the insulating base and the power supply boards, an upper end of the elastic plate is formed with a press portion above the power supply boards, when the press portion is pressed towards the mounting plate in the corresponding side slot, the buckle protrusion is disengaged from the edges of the insertion holes to disconnect the insulating base from the power supply boards.

2. The power supply board bridge connector as claimed in claim 1, wherein a middle of the bottom of the insulating base is formed with a spacer for separating the left and right power supply boards from each other.

3. The power supply board bridge connector as claimed in claim 1, wherein a middle of the receiving groove is provided with a support post for supporting the metallic elastic plate, and the support post cooperates with the insulating cover to position the metallic elastic plate in the receiving groove.

4. The power supply board bridge connector as claimed in claim 3, wherein the metallic elastic plate is in the form of a strip, left and right ends of the metallic elastic plate are bent downward to form arc sections and then extend toward the support post to form extension sections respectively, and the extension sections protrude downward to form the elastic contacts.

5. The power supply board bridge connector as claimed in claim 1, wherein each of the elastic contacts is formed with a slit.

6. A connecting structure using the power supply board bridge connector as claimed in claim 1, wherein the two left and right power supply boards are formed with the insertion holes, the left and right pins at the bottom of the insulating base are mated with the insertion holes of the two left and right power supply boards so that the insulating base bridges over the two power supply boards, and the two left and right elastic contacts of the metallic elastic plate pass through the through holes at the bottom of the receiving groove to be electrically connected to the left and right power supply boards respectively so as to achieve the bridging electrical connection between the two power supply boards.

* * * * *